United States Patent [19]

Hauber

[11] 4,061,370

[45] Dec. 6, 1977

[54] WINDOW LATCH

[75] Inventor: Peter Fritz Hauber, Burbank, Calif.

[73] Assignee: Reflectolite Products Inc., Sun Valley, Calif.

[21] Appl. No.: 661,476

[22] Filed: Feb. 26, 1976

[51] Int. Cl.[2] ..... E05C 1/10; E05C 1/04

[52] U.S. Cl. ..... 292/175; 70/90; 70/99; 70/432; 70/DIG. 81; 292/150; 292/DIG. 46

[58] Field of Search ..... 70/99, 100, 360, 432, 70/DIG. 81, 90; 292/32, 33, 42, 137, 145, 149, 150, 153, 157, 163, 164, 177, 181, 336.3, DIG. 20, DIG. 46, DIG. 47, 175

[56] References Cited

U.S. PATENT DOCUMENTS

| | | | |
|---|---|---|---|
| 70,895 | 11/1867 | Pridham | 292/149 |
| 191,844 | 6/1877 | Dennett | 292/153 |
| 310,787 | 1/1885 | Buckley et al. | 292/150 |
| 543,226 | 7/1895 | Atwood | 292/150 X |
| 758,394 | 4/1904 | Szucs | 70/DIG. 81 X |
| 1,111,511 | 9/1914 | Wecht | 292/42 |
| 1,158,816 | 11/1915 | Leeds | 292/150 |
| 1,510,562 | 10/1924 | Segal | 292/150 |
| 3,413,830 | 12/1968 | Rifkin | 292/150 X |
| 3,934,908 | 1/1976 | Rifkin | 292/150 |

FOREIGN PATENT DOCUMENTS

| | | | |
|---|---|---|---|
| 618,732 | 12/1926 | France | 292/150 |

*Primary Examiner*—Roy D. Frazier

*Assistant Examiner*—William E. Lyddane

*Attorney, Agent, or Firm*—John E. Wagner

[57] ABSTRACT

A window latch and handle assembly exhibiting an attractive appearance while providing a high degree of strength and small size. The assembly employs a pair of body members which are secured to a door or window frame and a unitary handle and latch. The handle extends from one side of the assembly of the two body parts and the latch from the opposite side thereof. A lock member with an elongated arm surface engages a key slot in the handle and latch. When in one orientation, the locking member allows the handle and latch to move laterally against the resistance of return spring and when turned 90°, effectively prevents movement of the handle and latch by direct broad area contact with one of the body parts. When rotated 90°, the lock member rests in the key slot allowing limited movement of the handle and latch to release the door or window. A captive spring beneath the locking member serves to cause the locking member to spring outward into a visible position whenever it is in unlocked position thereby signalling the condition of the latch. When it is in a locked position, the locking member having merely a screw head, appears merely as an assembly screw thereby avoiding unauthorized persons from detecting its true function. The lock member may include a non-standard shape opening to additionally prevent unauthorized persons from unlocking the latch.

4 Claims, 12 Drawing Figures

FIG. 7
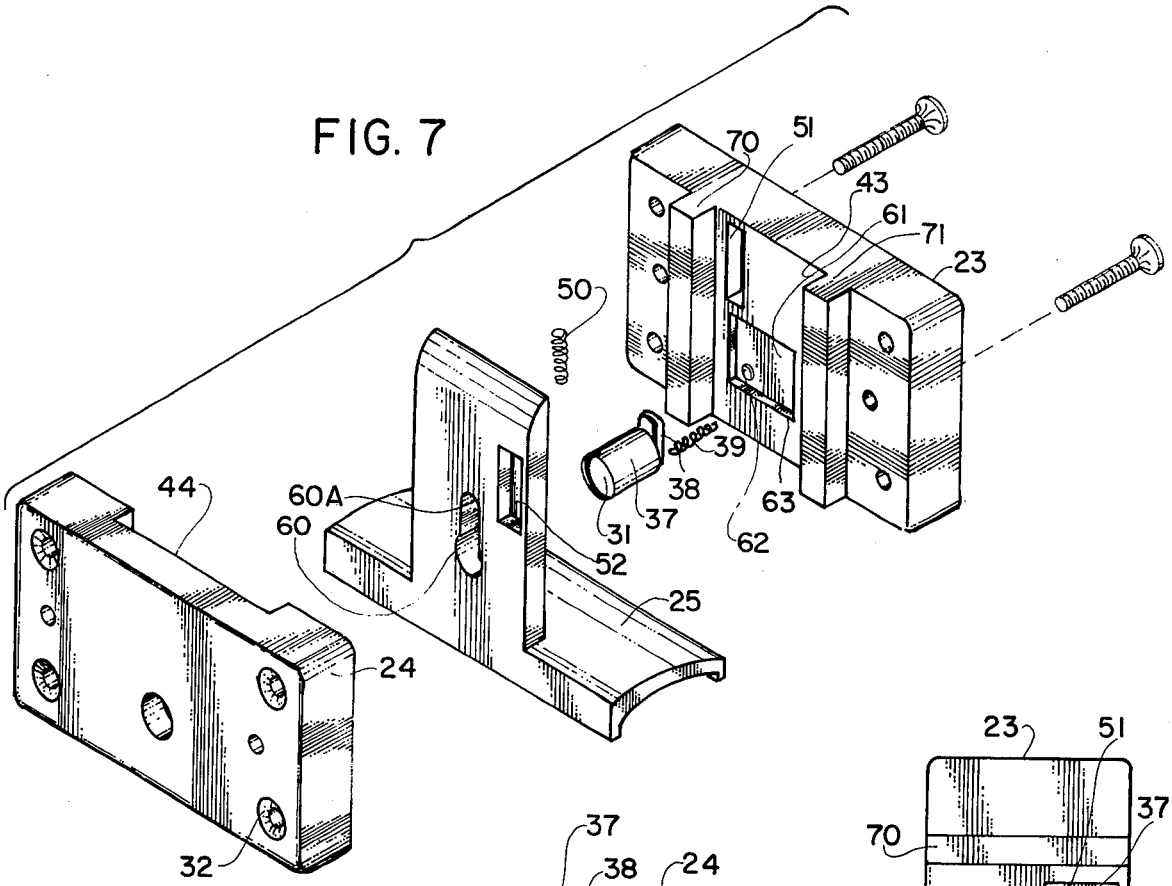
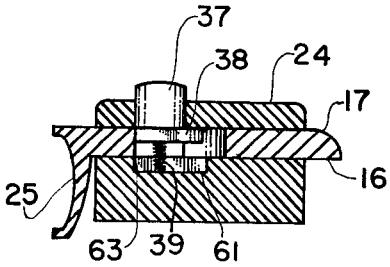
FIG. 8
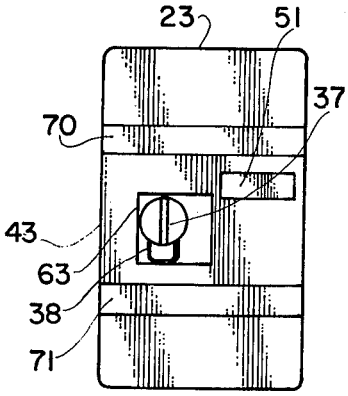
FIG.9
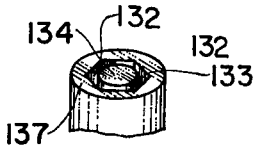
FIG. 12
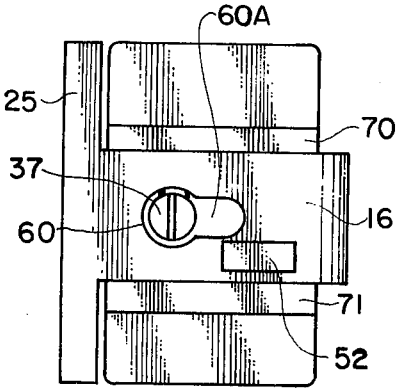
FIG. 10
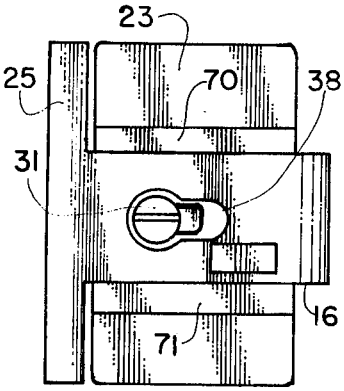
FIG.11

WINDOW LATCH

BACKGROUND OF THE INVENTION

Throughout the years many types of window and door latches have been developed. There exits, however, a present need for a simple effective latch member with a minimum number of parts and one which exhibits a high degree of strength despite simplicity. Further, there is a need that a device be simple, foolproof, and if possible, that its mode of release be at least in part concealed from unauthorized persons.

BRIEF DESCRIPTION OF THE INVENTION

With the foregoing need in mind, it is a general object of this invention to provide an improved self-latching window and door latch assembly. It is a further object of this invention to provide such an improvement which is simple, effective, low in cost, and yet attractive. A further object of this invention is to provide such a latch which has a minimum number of parts and which provides broad area of locking when the device is in a locked position. Another object of this invention is to so provide an improved lock in which the locking and unlocking member employs a conventional tool but which to the uninitiated, when in a locked position, takes on the appearance of a simple fastener. Another object of this invention is to provide a locking an unlocking device, which when in an unlocked position, provides a readily apparent indication of its being in an unlocked position.

This invention comprises briefly a pair of generally rectangular body parts which together define a transverse aperture through which the latch member extends. The latch member has an integral handle on one end and the latch on the opposite end. It includes a key hole shaped opening. A return spring is nested half within one of the body parts and half within the latch member whereby it exerts a closing force on the latch at all times. A locking operator extends through at least one of the body members and through the keyhole portion of the latch member. The locking operator is contoured to include an arm which in one position rides freely in the keyhole and in another position, prevents the latch member from movement. The locking member has a simple screw head appearance. Spring means engages one body member and the locking member to eject it partially from the body whenever it is in an unlocked position. In an alternate embodyment, the locking member includes a non-standard recess for locking and unlocking.

BRIEF DESCRIPTION OF THE DRAWING

This invention may be more clearly understood from the following detailed description and by reference to the drawing in which:

FIG. 7 is an exploded view of the latch assembly of this invention;

FIG. 8 is a sectional view taken along line 8—8 of FIG. 5;

FIG. 9 is an elevational view of the base of the body with the locking member in place;

FIG. 10 is an elevational view of the latch of this invention with its cover removed and in a locked position;

FIG. 11 is an elevational view similar to FIG. 10 when in an unlocked position; and FIG. 12 is a fragmentary elevational view of an alternate form of locking member for use in this invention.

DETAILED DESCRIPTION OF THE INVENTION

Figure 1:
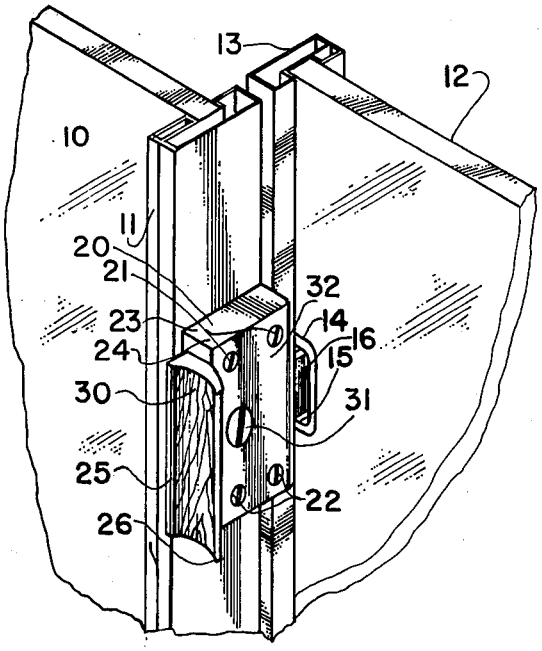
FIG. 1 is a perspective view of a typical window installation employing a latch of this invention.

Now referring to FIG. 1, a typical installation of a window 10 having a frame or stile 11 engaging a second window 12 with its frame or stile 13 may be seen therein. The frame 13 includes an outward extending tab 14 with an elongated recess 15 therein for engaging with the latch 16 of the latching and locking assembly 20 of this invention. The assembly 20 is secured to the frame 11 by a number of screws 21 and 22. The lock assembly 20 includes a pair of body parts 23 and 24 which are held together by fastening means unshown in FIG. 1 but typically are a pair of recessed machine screws which enter apart form the rear side and may be seen in FIG. 7.

A handle 25 which presents a readily graspable overhang portion 26 and appearance enhancing wood grain covering 30 over a portion of the handle is formed integral with the latch 16. In addition to the foregoing, the latch assembly includes a locking member or screw, the head 31 of which is visible in the surface 32 of the body portion 24. As will be described below in more detail, the locking member 31 is rotatable by 90° and in doing so either latches or unlatches the handle 25. This is more clearly illustrated in FIGS. 2 through 5 which reference is now made.

Figure 2:
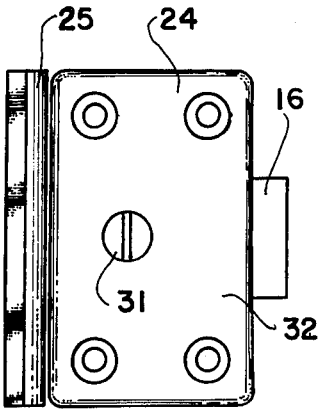
FIG. 2 is a front elevational view of the latch of this invention when in a locked position.
Figure 3:
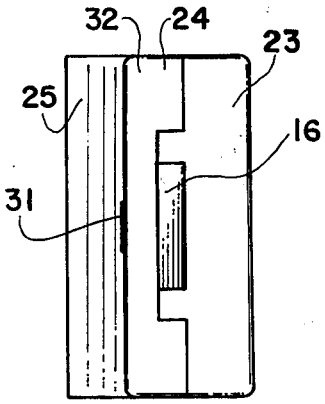
FIG. 3 is a side elevational view of the latch of FIG. 2.

In FIG. 2, the locking member is shown in its locked position and the relative positioning of the handle 25 with respect to the body parts 23 and 24 may be clearly seen. As seen in FIG. 3, the screw head 31 is virtually flush with the surface 32 and this remains unobtrusive and presents an appearance much like a conventional assembly fastener such as screws 21 and 22 of FIG. 1.

Figure 4:
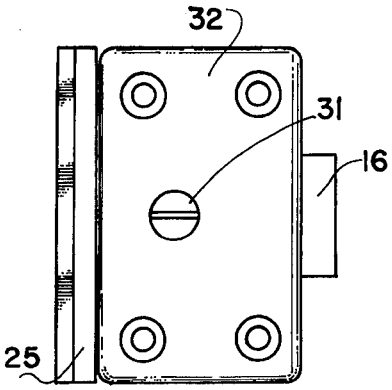
FIG. 4 is a side elevational view of the latch assembly of this invention when in an unlocked position.
Figure 5:
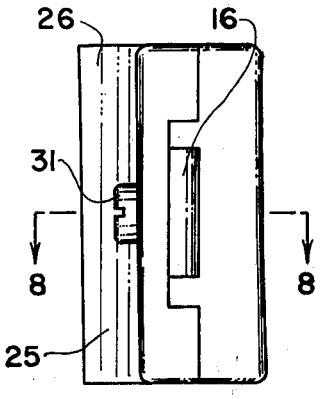
FIG. 5 is a side elevational view of the latch assembly of this invention when in an unlocked position.
Figure 6:
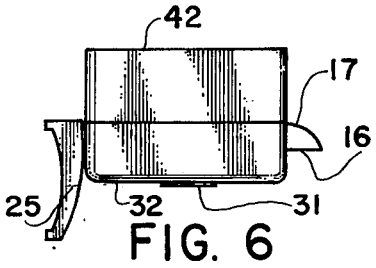
FIG. 6 is a top view of the latch assembly of this invention.

By now comparing FIGS. 4 and 5, it may be seen that the screw 31 has been turned 90° and as it appears in FIG. 3, now protrudes above the the surface 32. The protursion may be in the order of 3/16 of an inch on a fastener of approximately 2 inches in overall length. This protrusion is readily apparent when viewed from the side or the front of the window and gives a clear indication that the latch is unlocked. As shown in FIGS. 4 and 5, the application of finger pressure to the handle 25 in a direction to the left in FIG. 4 and into the paper in FIG. 5 causes a movement of the latch 16 into the body assembly thereby releasing the window 10 of FIG. 1. As more clearly seen in FIG. 6, to which reference is now made, the handle 25 extends to one side either beyond the surface 32 or above the surface 42 which constitutes a mounting surface of the assembly. The latching region 16 of handle 25 is self latching and includes the camming surface 17 to allow automatic closing in a manner well known in the latch field. The direction of closing and latching may be reversed simply by a reversal of a part of the handle 25 as will be apparent in connection with the description of the following drawing figures.

Now referring to FIG. 7 wherein the latch assembly of this invention is shown in exploded view, it is readily apparent that the handle 25 and latch portion 16 are integral and that the interconnecting body portion of the handle 25 rests in a transverse rectangular groove 43 of the base member 23 between ribs 70 and 71. A mating groove portion 44 in the body top 24 cooperates with the groove 42 to define an aperture through the latch 20. Additional parts visible in FIG. 7 including a return spring 50 which rests half within a slot 51 extending in the direction of movement of the latch handle 25 and the other half in a mating slot unshown in the drawing FIG. 7 but corresponding in position and size to the presently unused slot 52 in the near face of the latching member 16 of handle 25.

As indicated above, handle 25 may be reversed as in FIG. 7 by a 180° rotation around a vertical axis. In such case, the slot 52 will mate with the slot 51 with the spring 50 therebetween and the direction of the camming and latching as defined by the cam surface 17 is reversed.

Additional features of invention apparent in FIG. 7 include a keyhole opening 60 in the latch 16 and the details of the screw 37 having head 31 including a locking arm 38 and an ejection spring 39.

A recess 61 is formed in the surface defining the bottom of the longitudinal groove 43. This recess 61 includes a sub-recess 62 in which the end of spring 39 is positioned and includes a wall 63 against which the arm 38 rests when the locking member 37 is rotated by 90° and thus the latch is in a locked position. Direct metal to metal contact between the side wall of the arm 38 and the wall 63 provides positive locking of the position of the latch 16.

When the locking member 37 is in the position shown in FIG. 7 and the latch assembled, it is of course in the unlocked position and is partially ejected at least to a level above the surface of recess 61 with the arm 38 nested in the keyhole slot extension 60A. Note that the length of the keyhole slot extension 60A is greater than arm 38. This difference in length determines the degree of withdrawal of the latch 16 before stopping. The end of the arm 38 acts as a positive stop for the extent of withdrawal of the latch 16. Note also in FIG, 7 that the opening in the surface 32 of the body member 24 is circular and that the arm 38 therefore may not pass through there. The under surface of body member 24 defining the groove 44 acts as a stop from withdrawal of the locking member 37. Thus, it may be seen, that by simple and effective cooperation between the parts of this invention above described, a self-latching, 90° locking and unlocking latch assembly is achieved with positive protection against lock forcing by direct solid metal to metal contact. Likewise, an indication of the condition of the locking member is readily apparent. A degree of concealment of the latching member and locking member is possible since when in a locked position, it only appears as a screw slot much like the fasteners which secure the latch to the window.

The unitary nature of the handle 25, latch 16, and its contoured camming surface 17 may be seen in FIG. 8. There also the cooperative arrangement of the locking member 37 and the latch 16 and top 24 may be seen. Note that in the unlocked position as shown in FIG. 8, the arm 38 rests in the keyhole 60A of the latch 16 thereby allowing its free movement responsive to finger pressure to the left in the drawing of handle 25 in FIG. 8.

Now referring to FIGS. 9, 10, 11, two additional features of this invention may be seen wherein the body member 23 includes a pair of ribs 70 and 71 which define the edge of the recess 43 and the direction of travel of the latch member 16 shown in previous figures. In FIG. 9, the relationship of the operator 37 and particularly its arm 38 to the recess 61 may be seen. When in the locked position as shown in FIG. 9, the side of arm 38 rests virtually against wall 63 and since the lock member 37 is effectively captured by the top 24 and the body of member 37 extends through the enlarged portion of the keyhole 60 of the latch 16, the latch 16 and its handle 25 may not move. This is illustrated clearly in FIG. 10 where the latch member 37 virtually fills the entire circular aperture 60.

In FIG. 11, the arm 38 now extends into the keyhole slot 60A and the latch member 16 is free to move in opposition to the spring 50 of FIG. 7 to the left in the drawing until the end of arm 38 strikes the end of keyhole slot 60A.

FIG. 12 illustrates a slightly modified form of this invention in which the locking member 137 includes a specialized form of head for which only a specialized tool can be used to unlock the same. In this case, the head 131 includes a recess 132 having a hexagonal or other non-circular external wall 133 and a circular post 134 defining a second surface. Only a tool having a recess corresponding to the shape of post 134 or greater clearance and an operating surface corresponding to the hexagonal or other surface 133 can be inserted in the member to unlock the same. This modified locking member 137 of FIG. 12 may be substituted for the locking member 37 in each of the figures heretofore.

The above described embodiments of this invention are merely descriptive of its principles and are not to be considered limiting. The scope of this invention instead shall be determined from the scope of the following claims, including their equivalents.

What is claimed is:

1. A latch assembly comprising a body adapted to be attached to a window or door frame;

said body including a transverse aperture therethrough;

a unitary handle-latch member extending through said transverse aperture with a latching surface extending from said body on one side thereof and a handle extending from said body on the opposite side thereof;

said handle-latch member including a keyhole shaped aperture therethrough with an enlarged portion of said keyhole-shaped aperture positioned in the intermediate region of said handle-latch member between said handle and said latching surface with the enlarged portion nearer the handle and a constricted portion of said keyhole shaped aperture nearer the latching thereof;

a circular aperture in said body on one side of said handle-latch member communicating with said transverse aperture and said keyhole shaped aperture;

a locking member having a cylindrical portion of a size corresponding to said enlarged portion and being received within said circular aperture, said locking member including a substantially rectangular locking arm affixed to one end thereof with a portion of said arm extending laterally from said cylindrical portion, said arm dimensioned to have a width corresponding to said constricted portion and to rest in said keyhole shaped aperture when in unlocked position and with only the cylindrical portion thereof extending through the enlarged portion of the keyhole shaped aperture when depressed and rotated in the order of 90° to a locked position;

said body including a recess on the other side of said handle-latch member into which the arm of said locking member may be extended normal to the direction of movement of said handle-latch member;

a surface on said body engaging said arm when so extended and limiting the movement of said handle-latch member in the latch releasing direction;

said locking member operative in said locked position to prevent movement of said handle-latch member by engagement of the cylindrical portion thereof with the enlarged portion of the keyhole shaped aperture in said handle latch member;

said arm when in the locked position preventing withdrawal of the cylindrical portion from the enlarged portion of the keyhole shaped aperture;

said arm extends within said constricted portion of said keyhole shaped aperture in said handle latch member when in an unlocked position;

said arm having a length less than the length of said keyhole shaped aperture;

whereby the length of said arm limits the extent of unlocking movement of said handle-latch member;

first spring means urging said handle-latch member into a locking position; and second spring means partially ejecting said locking member from said body when in an unlocked position.

2. The combination in accordance with claim 1 wherein said body comprises a pair of mating body parts defining the said transverse aperture there between;

one of said body parts including said circular aperture which opens to said cylindrical portion only of said locking member thereby restraining said locking member from ejection when unlocked.

3. The combination in accordance with claim 1 wherein the other end of said locking member is generally at the level of the surface of said body when in a locking position and extending above the surface when in an unlocking condition whereby the unlocking condition is readily apparent.

4. The combination in accordance with claim 3 wherein said other end of said locking member includes a screw slot whereby said locking member when locked presents the appearance of a screw fastener in tightened condition; and wherein said second spring mechanically biases said locking member to a protruding condition when in unlocked condition to present the appearance of an untightened screw fastener.

* * * * *